US008368547B2

(12) United States Patent
Berke et al.

(10) Patent No.: US 8,368,547 B2
(45) Date of Patent: Feb. 5, 2013

(54) SYSTEM AND METHOD FOR VISUALLY INDICATING UNSAFE HANDLING TEMPERATURE OF AN INFORMATION HANDLING SYSTEM COMPONENT

(75) Inventors: Stuart Allen Berke, Austin, TX (US); Shawn P. Hoss, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 466 days.

(21) Appl. No.: 12/635,425

(22) Filed: Dec. 10, 2009

(65) Prior Publication Data

US 2011/0140898 A1 Jun. 16, 2011

(51) Int. Cl.
*G08B 17/00* (2006.01)

(52) U.S. Cl. ..... 340/584; 340/587; 340/589; 340/600; 340/579; 340/686.1; 340/521; 340/526; 340/454

(58) Field of Classification Search ..... 340/584, 340/587, 589, 600, 679, 686.1, 521, 526, 340/454

See application file for complete search history.

(56) References Cited

U.S. PATENT DOCUMENTS 6,529,135 B1 * 3/2003 Bowers et al. ..... 340/648
6,727,820 B2 * 4/2004 Pedoeem et al. ..... 340/584

OTHER PUBLICATIONS

United States patent Application; Berke et al.; U.S. Appl. No. 12/581,636; "System and Method for Safe Handling of Information Handling Resources"; pp. 29, Oct. 19, 2009.

* cited by examiner

*Primary Examiner* — Tai T Nguyen
(74) *Attorney, Agent, or Firm* — Baker Botts L.L.P.

(57) ABSTRACT

Systems and methods for indicating the unsafe service handling temperature of an information handling system component are disclosed. A method may include sensing a surface temperature of the component and comparing the surface temperature to a first and second threshold temperatures. The method may further include displaying various temperature warning by multiple temperature indicators if the surface temperature is above or below the threshold temperatures.

24 Claims, 6 Drawing Sheets

SYSTEM AND METHOD FOR VISUALLY INDICATING UNSAFE HANDLING TEMPERATURE OF AN INFORMATION HANDLING SYSTEM COMPONENT

TECHNICAL FIELD

The present disclosure relates in general to information handling systems, and more particularly to visually indicating unsafe handling temperatures of information handling system components.

BACKGROUND

As the value and use of information continues to increase, individuals and businesses seek additional ways to process and store information. One option available to users is information handling systems ("IHSs"). An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Increasingly, IHSs are deployed in architectures that increase the density both of components within an IHS and of IHSs within an operating environment. This increased density can lead to an increase in the temperatures under which components must operate. In addition to increased temperatures, increased reliance on IHSs leads to a heightened importance placed on the time in which an IHS is operational. Downtime caused by maintenance must increasingly be reduced by a variety of methods. When an IHS goes down, maintenance personnel must wait long periods of time before the IHS can be safely repaired. These increased maintenance times, compounded by the increased operating temperatures, cost companies money and business opportunities. Additionally, safety issues may arise in situations where service of the IHS requires access to components during a time when those components may be unsafe for handling.

SUMMARY

In accordance with the teachings of the present disclosure, the disadvantages and problems associated with unnecessary downtime of an information handling system have been substantially reduced or eliminated.

In accordance with one embodiment of the present disclosure, a method for indicating the unsafe service handling temperature of an information handling system component is provided. The method may include sensing a surface temperature of a portion of the component, comparing the surface temperature to a first and second threshold temperatures, and if the surface temperature is below the first threshold temperature, displaying a first temperature warning by a first temperature indicator, if the surface temperature is above the first threshold temperature, displaying a second temperature warning by the first temperature indicator, if the surface temperature is below the second threshold temperature, displaying a third temperature warning by a second temperature indicator, and if the surface temperature is above the second threshold temperature, displaying a fourth temperature warning by the second temperature indicator.

In accordance with another embodiment of the present disclosure, a system for indicating the unsafe service handling temperature of an information handling system component is provided. The system may include a first temperature indicator configured to respond to a change in the surface temperature by displaying a first temperature warning when the surface temperature is below a first threshold temperature and a second temperature warning when the surface temperature is above the first threshold temperature, and a second temperature indicator configured to respond to a change in the surface temperature by displaying a third temperature warning when the surface temperature is below a second threshold temperature and a fourth temperature warning when the surface temperature is above the second threshold temperature.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 4, wherein like numbers are used to indicate like and corresponding parts.

For the purposes of this disclosure, an information handling system ("IHS") may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a PDA, a consumer electronic device, a network storage device, or any other suitable device and may vary in size, shape, performance, functionality, and price. The IHS may include memory, one or more processing resources, such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The IHS may also include one or more buses operable to transmit communication between the various hardware components.

Figure 1:
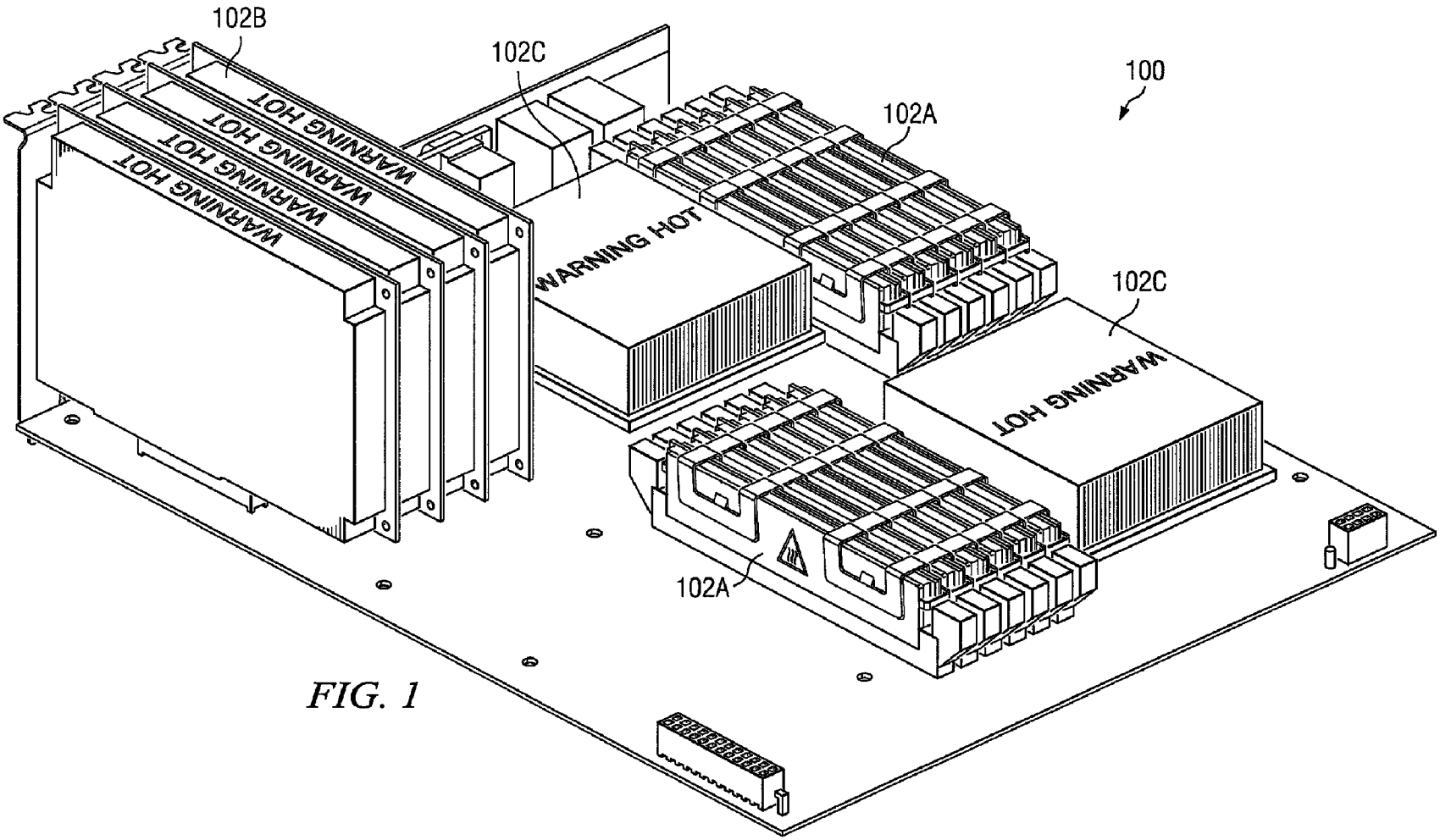
FIG. 1 illustrates an example information handling system for visually indicating unsafe handling temperatures in one or more components of information handling system, in accordance with certain embodiments of the present disclosure.

FIG. 1 illustrates an example information handling system 100 for visually indicating unsafe handling temperatures in one or more components 102 of information handling system 100, in accordance with certain embodiments of the present disclosure. Component(s) 102 may be any device configured to visually indicate that the surface temperature of a portion of component(s) 102 is unsafe for handling during service of information handling system 100, or that a portion of another component(s) 102 of information handling system 100 proximate to component(s) 102 are unsafe for handling during service of information handling system 100, as described in more detail below with reference to FIGS. 2A-2C. In particular embodiments, components 102, or proximate components 102, may become hot, for example during use of the IHS, and may need to cool to become safe for handling.

In the example embodiment, three different types of components 102 are shown. These components are labeled as 102A, 102B, and 102C for ease of reference. However, in other embodiments, more, fewer, or different components may be used. In some embodiments, component 102A may be a memory component communicatively coupled to information handling system 100, such as a dual inline memory module ("DIMM"). In the example embodiment, component 102A is shown with a visual indication that contact with component 102A would be dangerous in servicing, as described in more detail below with reference to FIGS. 2A-2C.

In some embodiments, component 102B may be an expansion card communicatively coupled to information handling system 100, such as a peripheral component interconnect express ("PCIE") card. In the example embodiment, component 102B is shown with a visual indication that contact with component 102B would be dangerous in servicing.

In some embodiments, component 102C may be a heat sink coupled to a processor of information handling system 100. In the example embodiment, component 102C is shown with a visual indication that contact with component 102C would be dangerous in servicing.

The capability to accurately know when component 102 may be safely handled can have a significant effect on downtime for repair of an IHS. As an illustrative example, for component 102A, a memory component with a metal element (e.g., a heat spreader) coupled to the memory component, the amount of time required to cool to a safe handling temperature may vary widely with the circumstances of a system failure. In a circumstance in which power to IHS 100 is removed and component 102A allowed to cool down from a maximum temperature of 80-85 degrees Celsius, component 102A may not be able to be safely handled for six to 13 minutes. As a matter of operating procedure, one servicing IHS 100 may have to wait for the maximum amount of time in that range before handling component 102A. However, if component 102A includes a visual indication of its surface temperature in a way that may be easily witnessed by the one servicing IHS 100, this downtime may be reduced to the minimum necessary. For instance, the one servicing IHS 100 may be able to wait only six minutes, after which contact with component 102A may be hot, but not physically harmful, rather than the entire cooldown period. Additionally, a fan or other external cooling device may be used to speed cooling of component 102A. In such a situation, the cooling time may be reduced to a range of one to two minutes. However, different cooling devices cool at different rates and it is often impossible to know, simply by the passage of time, whether component 102A is safe for handling. The inclusion of one or more reversible temperature indicators on component 102 may greatly improve the response time for servicing IHS 100, as described in more detail below with reference to FIGS. 2A-2C and FIG. 3.

FIGS. 2A-2C and FIG. 3 are provided as illustrative examples only and are not intended to limit the scope of the present disclosure. The methods and systems disclosed may be applied to any appropriately configured component 102 of information handling system 100. For example, FIGS. 2A-2C describe the disclosed methods and systems as applied to a memory component using labels as temperature indicators. As an additional example, FIG. 3 describes the disclosed methods and systems as applied to a memory component using a mechanical actuator as temperature indicators. However, other components 102 of information handling system 100 may be appropriately configured, such as an expansion card, heat sink, graphics processor, battery, charger, power supply, microprocessor, or chassis of information handling system 100.

Figure 2A:
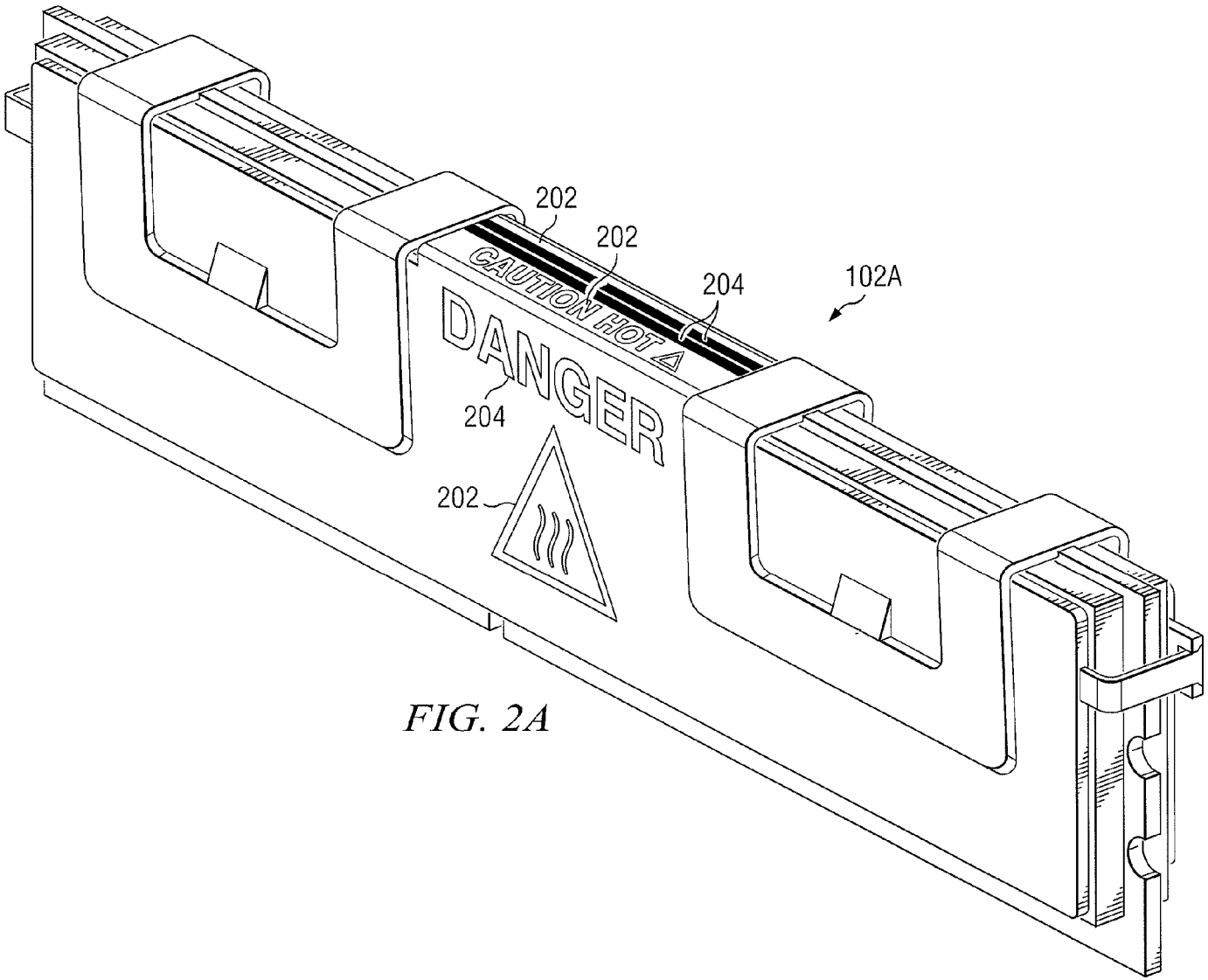
FIG. 2A illustrates an example component configured to visually indicate an unsafe handling temperature, in accordance with certain embodiments of the present disclosure.

FIG. 2A illustrates an example component 102A configured to visually indicate an unsafe handling temperature, in accordance with certain embodiments of the present disclosure. In the example embodiment, component 102A is a memory component coupled to information handling system 100. Component 102A includes a first reversible temperature indicator 202 and a second reversible temperature indicator 204. In the example embodiment, component 102A is at an unsafe handling temperature. For example, for a memory component with a metal element (e.g., a heat spreader) coupled to the memory component, it may cause physical harm to one servicing information handling system 100 when the surface temperature of a portion of component 102A is above 70 degrees Celsius. Physical harm may include burns, blisters, or other damage to the human hand or skin.

If the surface temperature of component 102A is above this first predetermined threshold temperature, then both the first reversible temperature indicator 202 and second reversible temperature indicator 204 may be activated. At temperatures below this first threshold temperature, one or neither of the temperature indicators may be activated, as described in more detail below with reference to FIGS. 2B-2C.

In some embodiments, first reversible temperature indicator 202 and second reversible temperature indicator 204 are labels affixed to component 102A, depicting warning graphics and text. In other embodiments, first reversible temperature indicator 202 and second reversible temperature indicator 204 may be color-changing paints, dye, clay, thermochromic liquid crystals, pigments, or any other material capable of displaying a visual indication above a predetermined threshold temperature, adhering to or embedded in component 102A, and reversing the visual indication below the first predetermined threshold temperature. Additionally, in some embodiments first reversible temperature indicator 202 and second reversible temperature indicator 204 may display graphics, letters, colors, or other appropriate visual indicators.

In other embodiments, the first threshold temperature may be predetermined at different levels depending on the material properties of component 102. For instance, for component 102 made from glass, the temperature at which contact may be unsafe and cause physical harm above 80 degrees Celsius. Additionally, for component 102 made from plastic, the temperature at which contact may be unsafe and cause physical harm may be above 95 degrees Celsius.

Once the surface temperature of component 102A falls below the first predetermined threshold temperature, first reversible temperature indicator 202 may be configured to reverse the visual indication of unsafe handling, as described in more detail below with reference to FIGS. 2B-2C.

In some embodiments, both the first and second reversible temperature indicators 202, 204 may be visible at the same time. For instance, in the example embodiment, first reversible temperature indicator 202 includes the "CAUTION HOT" text and warning triangle, while second reversible temperature indicator 204 includes the "DANGER" text. This arrangement may be preferable in situations in which increasing levels of warning are desired. In other embodiments, second reversible temperature indicator 204 may be configured to effectively render first reversible temperature indicator 202 non-visible to the user servicing information handling system 100. For instance, in one configuration, component 102 (e.g., a heat sink) may be painted with a temperature-responsive paint configured to change to a first color (e.g., yellow) above a first threshold temperature and a second color (e.g., red) above a second threshold temperature. In such a configuration, first reversible temperature indicator 202 may be the first color and second reversible temperature indicator 204 may be the second color. In such a configuration, the visual cue provided by first reversible temperature indicator 202 may be subsumed by that provided by second reversible temperature indicator 204.

In some embodiments, component 102A may be configured to reflect the ambient temperature around component 102A rather than the surface temperature of component 102A. In some configurations of information handlings system 100, it may be helpful to one servicing IHS 100 to know when a particular area within IHS 100 is above a threshold temperature. In other embodiments, component 102A may be configured to reflect the surface temperature of another component 102 of information handling system 100 proximate to component 102A. This other component 102 may not be of a sufficient size or shape to make affixing a label or other first and second temperature indicators 202, 204 to the other component. In such a configuration, it may be more practical to activate first and second temperatures indicators 202, 204 of component 102A in response to the surface temperature of another, proximate component 102. In still other embodiments, component 102A may be configured to reflect some combination of the surface temperature of component 102A, the ambient temperature around component 102A, and/or the surface temperature of a component 102 proximate to component 102A.

Figure 2B:
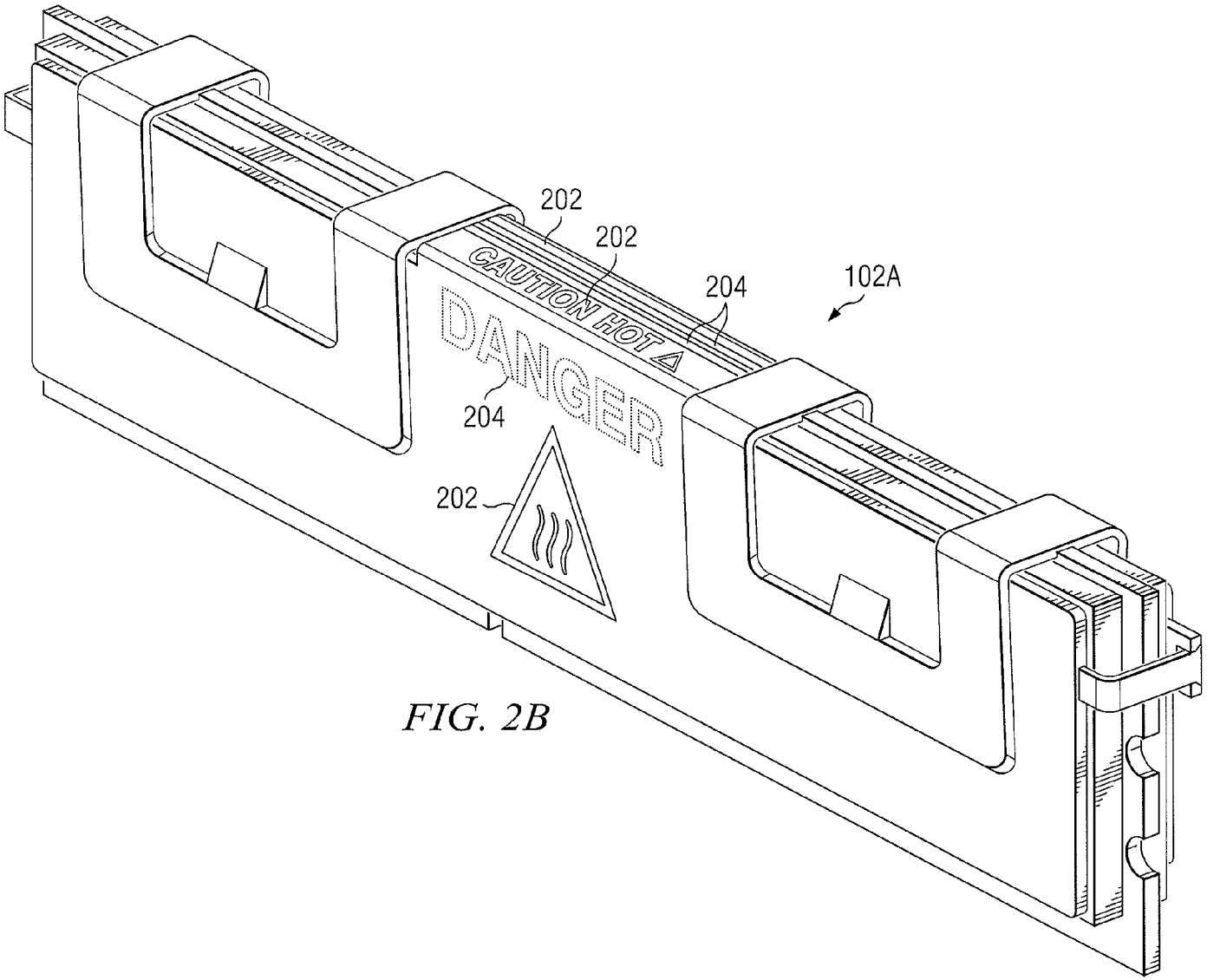
FIG. 2B illustrates an example component configured to visually indicate an unsafe handling temperature, in accordance with certain embodiments of the present disclosure.

FIG. 2B illustrates an example component 102A configured to visually indicate an unsafe handling temperature, in accordance with certain embodiments of the present disclosure. In the example embodiment, component 102A is a memory component coupled to information handling system 100. Component 102A includes a first reversible temperature indicator 202 and a second reversible temperature indicator 204. In the example embodiment, component 102A is at a surface temperature that may be physically painful to one servicing information handling system 100, but would not cause physical harm such as burns or blisters. For example, for a memory component with a metal element (e.g., a heat spreader) coupled to the memory component, it may be unsafe to handle above 70 degrees Celsius, but still painful between 50 and 70 degrees Celsius. If the surface temperature of component 102A is above this second predetermined threshold temperature where component 102A may be painful to touch (e.g., 50 degrees Celsius), then only first reversible temperature indicator 202 may be activated. At temperatures below this threshold temperature, neither of the temperature indicators may be activated, as described in more detail below with reference to FIG. 2C.

In other embodiments, the threshold temperatures may be predetermined to be at different levels. For instance, for component 102 made from glass, the temperature at which component 102 may be painful to touch but not physically harmful may be in the range of 60 to 80 degrees Celsius. Additionally, for component 102 made from plastic, the temperature at which component 102 may be painful to touch but not physically harmful may be in the range of 75 to 95 degrees Celsius.

Once the surface temperature of component 102A falls below the second predetermined threshold temperature, second reversible temperature indicator 204 may be configured to reverse the visual indication of unsafe handling, as described in greater detail below with reference to FIG. 2C.

In some embodiments, first and second reversible temperature indicators 202, 204 are labels affixed to component 102A, depicting warning graphics and text. In other embodiments, first and second reversible temperature indicators 202, 204 may be color-changing paints, dyes, clays, thermochromic liquid crystals, pigments, or any other material capable of displaying a visual indication above a predetermined threshold temperature, adhering to or embedded in component 102A, and reversing the visual indication below the predetermined threshold temperature. Additionally, in some embodiments first reversible temperature indicator 202 and second reversible temperature indicator 204 may display graphics, letters, colors, or other appropriate visual indicators.

Figure 2C:
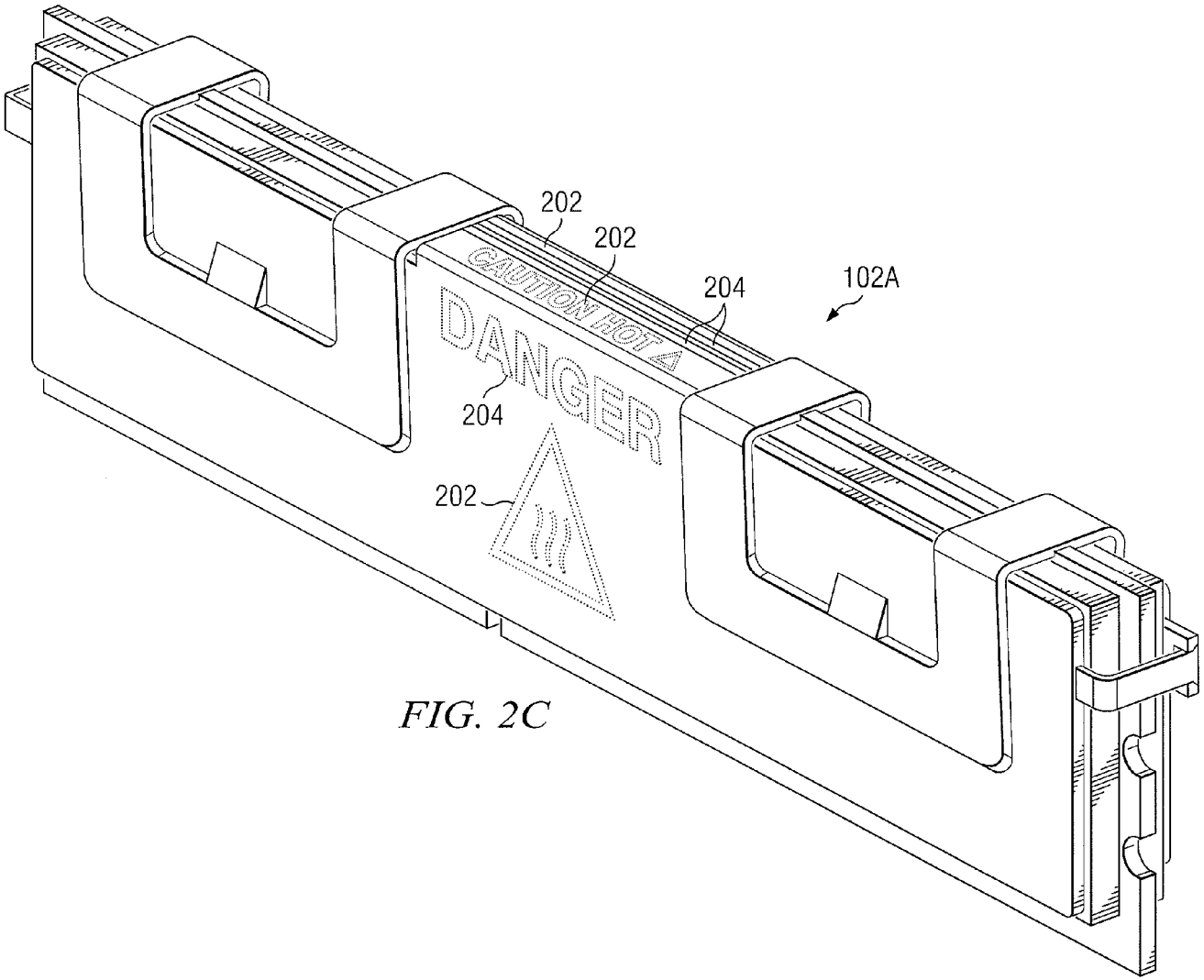
FIG. 2C illustrates an example component configured to visually indicate an unsafe handling temperature, in accordance with certain embodiments of the present disclosure.

FIG. 2C illustrates an example component 102A configured to visually indicate an unsafe handling temperature, in accordance with certain embodiments of the present disclosure. In the example embodiment, component 102A is a memory component coupled to information handling system 100. Component 102A includes a first reversible temperature indicator 202 and a second reversible temperature indicator 204. In the example embodiment, component 102A is at a surface temperature that is safe for servicing component 102A. For example, for a memory component with a metal element (e.g., a heat spreader) coupled to the memory component, it may be safe (e.g., neither painful nor physically harmful) to handle at a surface temperature below 50 degree Celsius for one servicing information handling system 100. If the surface temperature of component 102A is above this predetermined threshold temperature, then one or more of first reversible temperature indicator 202 and second reversible temperature indicator 204 may be activated, as described in greater detail above with reference to FIGS. 2A-2B.

In other embodiments, the threshold temperatures may be predetermined to be at different levels. For instance, for component 102 made from glass, the temperature at which component 102 may be neither painful nor physically harmful may be below 60 degrees Celsius. Additionally, for component 102 made from plastic, the temperature at which component 102 may be neither painful nor physically harmful may be below 75 degrees Celsius.

At surface temperatures below the threshold temperature, first reversible temperature indicator 202 and second reversible temperature indicator 204 may be configured to not display any visual indication of unsafe handling. For instance, the warning labels and/or text described above with reference to FIGS. 2A-2B may not be present.

In some embodiments, first reversible temperature indicator 202 and second reversible temperature indicator 204 are labels affixed to component 102A, depicting warning graphics and text. In other embodiments, first reversible temperature indicator 202 and second reversible temperature indicator 204 may be color-changing paints, dyes, clays, thermochromic liquid crystals, pigments, or any other material capable of reversibly displaying a visual indication above a predetermined threshold temperature and adhering to or embedded in component 102A. Additionally, in some embodiments first reversible temperature indicator 202 and second reversible temperature indicator 204 may display graphics, letters, colors, or other appropriate visual indicators.

Figure 3:
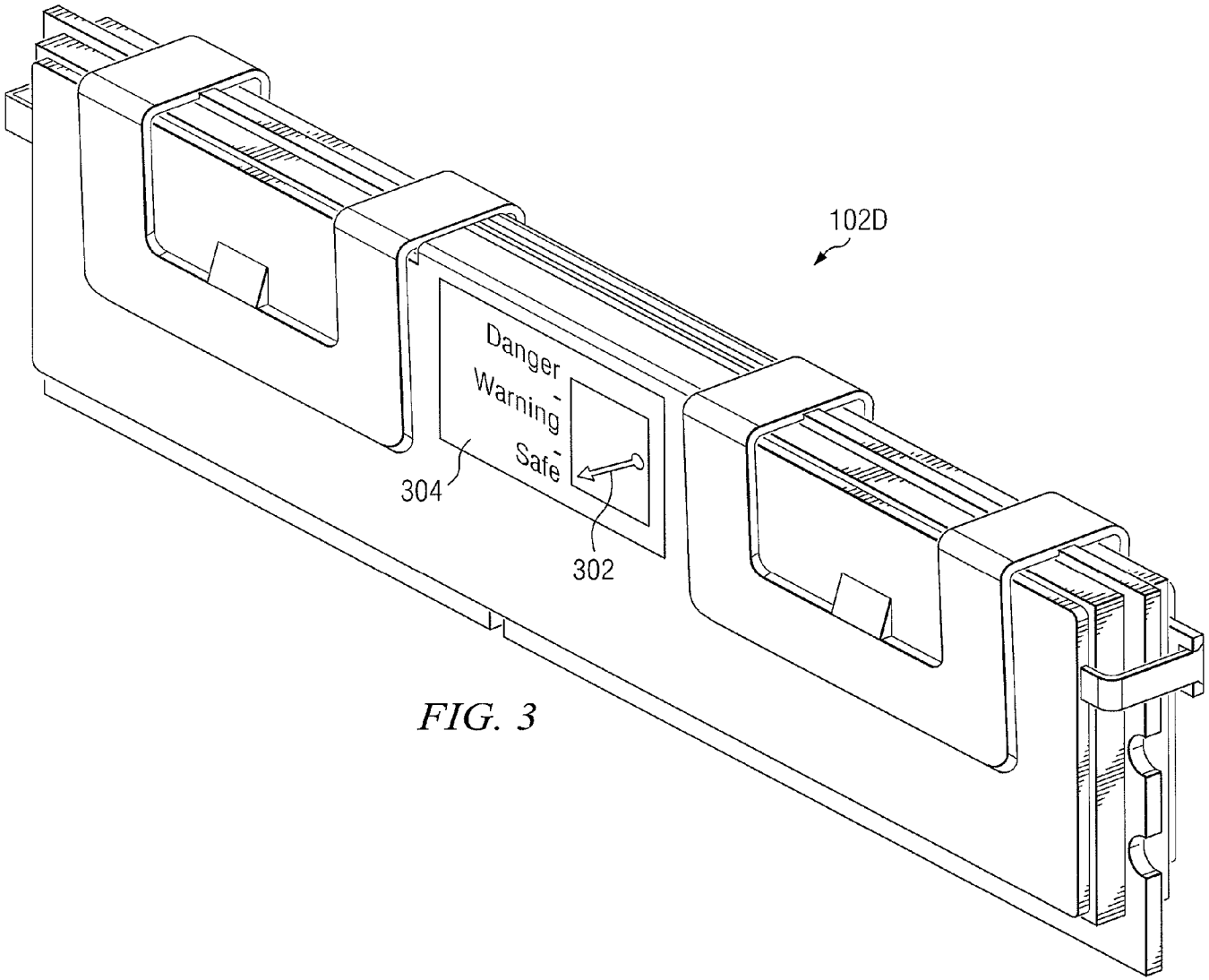
FIG. 3 illustrates an example component configured to visually indicate an unsafe handling temperature, in accordance with certain embodiments of the present disclosure.

FIG. 3 illustrates an example component 102D configured to visually indicate an unsafe handling temperature, in accordance with certain embodiments of the present disclosure. In the example embodiment, component 102D is a memory component coupled to information handling system 100. Component 102D may include a mechanical actuator 302 configured to move between four positions, with the first position associated with being below a first threshold temperature (indicating that component 102D may be safe to handle), the second position associated with being above the first threshold temperature, the third position associated with being below a second threshold temperature (indicating that component 102D is not at a temperature that will physically damage a human hand), and the fourth position associated with being above that second threshold temperature.

In some embodiments, component 102D may also include warning label 304 associated with mechanical actuator 302. Warning label 304 may provide visual indications to one servicing information handling system 100 that component 102D may be safe or unsafe for handling. In the illustrated embodiment, warning label 304 includes the text "Safe," "Warning," and "Danger." The "Safe" text may be positioned in such a way within warning label 304 as to be associated with the first position of mechanical actuator 302. When mechanical actuator 302 is in the first position, as in the illustrated embodiment, one servicing information handling system 100 can be made aware that contact with component 102D may be neither painful nor physically harmful (e.g., below 50 degrees Celsius). The "Warning" text may also be positioned in such a way within warning label 304 as to be associated with the second and/or third positions of mechanical actuator 302. When mechanical actuator 302 is in the second and/or third position, one servicing information handling system 100 can be made aware that contact with component 102D may be painful to touch (e.g., above 50 degrees Celsius), but may not cause physical harm (e.g., below 70 degrees Celsius). Likewise, the "Danger" text may be positioned in such a way within warning label 304 as to be associated with the fourth position of mechanical actuator 302. When mechanical actuator 302 is in the fourth position, one servicing information handling system 100 can be made aware that contact with component 102D may cause physical harm such as burns and/or blisters (e.g., above 70 degrees Celsius).

In the illustrated embodiment, mechanical actuator 302 is composed of a Shape Memory Alloy. This type of material "remembers" its original, cold, forged shape, and returns to that shape after being deformed by heat. With such properties, mechanical actuator 302 may move substantially continuously between its first and second, and third and fourth positions as temperature changes. For instance, the original shape of mechanical actuator 302 may be designed to be the first position, and the maximum allowed deformation (e.g., the maximum deformation at which mechanical actuator 302 can "remember" its original shape) may be designed to be the fourth position, with the second and third positions corresponding to intermediary levels of heat-induced deformity. In other embodiments, mechanical actuator 302 may be an object composed of two or more different metals layered together that convert a temperature change into a mechanical displacement.

As described in above with reference to FIGS. 2A-2C, the threshold temperatures may be determined to be at different levels. Additionally, in other embodiments, the visual indications provided by warning label 304 may comprise colors, other text, or other suitable visual indicators of safe or unsafe handling temperature of component 102D of information handling system 100.

In some embodiments, mechanical actuator 302 may be configured to move between a first and second position, where the first position hides a portion of warning label 304 and the second position reveals that portion of warning label 304, indicating that contact with component 102D may be painful (e.g., above 50 degrees Celsius). Likewise, mechanical actuator 302 may be further configured to move between a third and fourth position, revealing a different portion of warning label 304 to indicate that contact with component 102D may cause physical harm on contact (e.g., above 70 degrees Celsius). The blocked/revealed portions of warning label 304 may comprise text, graphics, colors, or other appropriate visual indicators of safe or unsafe handling of component 102D of information handling system 100.

In still other embodiments, component 102D may include a plurality of mechanical actuators 302 and associated warning labels 304. Mechanical actuator(s) 302 may also be configured to move discretely, rather than continuously, between the first and second positions, and between the third and fourth positions. FIGS. 2A-2C and FIG. 3 are provided as illustrative examples only and are not intended to limit the scope of the present disclosure. It may also be apparent to one of skill in the art, in light of the present disclosure, to combine the illustrative examples of FIGS. 2A-3 into further combinations. For example, a component 102 may include a mechanical actuator 302 configured to move between a first and second, and a third and fourth positions, as described in more detail above with reference to FIG. 3. Warning label 304 of component 102 associated with mechanical actuator 304 may be made up of color-changing dyes, text, and/or labels, as described in more detail above with reference to FIGS. 2A-2C.

Figure 4:
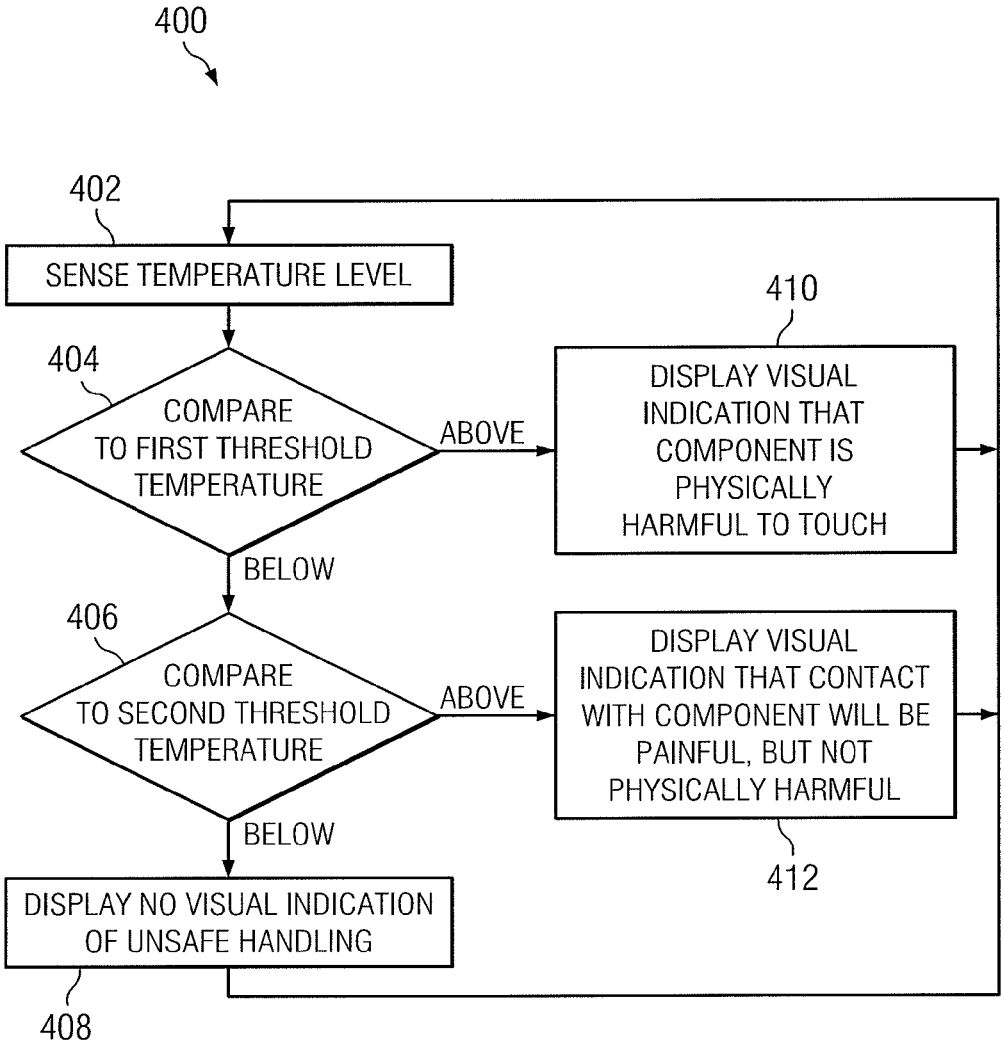
FIG. 4 illustrates a flow chart of an example method for providing a visual indication of unsafe handling temperature of a component of information handling system, in accordance with certain embodiments of the present disclosure.

FIG. 4 illustrates a flow chart of an example method 400 for providing a visual indication of unsafe handling temperature of a component 102 of information handling system 100, in accordance with certain embodiments of the present disclosure. Method 400 includes establishing warning threshold temperatures, determining the appropriate warning types, and affixing the visual indicators to a component 102.

According to one embodiment, method 400 preferably begins at step 402. Teachings of the present disclosure may be implemented in a variety of configurations of information handling system 100. As such, the preferred initialization point for method 400 and the order of steps 402-412 comprising method 400 may depend on the implementation chosen.

At step 402, method 400 senses the appropriate temperature level. In some embodiments, this may be the surface temperature of a portion of component 102. In other embodiments, it may be the ambient temperature around component 102 or the surface temperature of a second component proximate to component 102. After sensing the temperature, method 400 may proceed to step 404.

At step 404, method 400 compares the sensed temperature to a first threshold temperature to determine whether the sensed temperature is above or below the first threshold temperature. The comparison may be performed through a chemical reaction or chemical change, for example in a visual indicator such as a reversible temperature indicator.

In some embodiments, the first threshold temperature is the temperature at which contact with component 102 by one servicing information handling system 100 may be unsafe, as described in more detail above with reference to FIGS. 2A-2C. If the sensed temperature is above the first threshold temperature, then method 400 may proceed to step 412. If it is below the first threshold temperature, then method 400 may proceed to step 406.

At step 406, method 400 compares the sensed temperature to a second threshold temperature to determine whether the sensed temperature is above or below the second threshold temperature. In some embodiments, the second threshold temperature is the temperature at which contact with component 102 by one servicing information handling system 100 may be painful but not unsafe, as described in more detail above with reference to FIGS. 2A-2C. If the sensed temperature is above the second threshold temperature, then method 400 may proceed to step 410. If it is below the second threshold temperature, then method 400 may proceed to step 408.

At step 408, component 102, via first and second temperature indicators 202, 204 may display no visual indication of unsafe handling, as described in more detail above with reference to FIGS. 2A-2C. In some embodiments, this may be the lack of a warning text or symbols. Once displayed, method 400 may return to step 402 to continue monitoring temperature.

At step 410, component 102, via first and second temperature indicators 202, 204 may display some visual indicators that component 102 may be painful to touch, but may not be unsafe, as described in more detail above with reference to FIGS. 2A-2C. Once displayed, method 400 may return to step 402 to continue monitoring temperature.

At step 412, component 102, via first and second temperature indicators 202, 204 may display some visual indicators that contact with component 102 may be unsafe, as described in more detail above with reference to FIGS. 2A-2C. Once displayed, method 400 may return to step 402 to continue monitoring temperature.

Although FIG. 4 discloses a particular number of steps to be taken with respect to method 400, method 400 may be executed with greater or lesser steps than those depicted in FIG. 4. In addition, although FIG. 4 discloses a certain order of steps to be taken with respect to method 400, the steps comprising method 400 may be completed in any suitable order.

Using the methods and systems disclosed herein, problems associated with downtime of information handling systems while waiting for components to cool may be improved, reduced, or eliminated. For example, the methods and systems disclosed herein provide a method and system for visually indicating the unsafe handling of information handling system components.

Although the present disclosure has been described in detail, it should be understood that various changes, substitutions, and alterations can be made hereto without departing from the spirit and the scope of the disclosure as defined by the appended claims.

What is claimed is:

1. A method for indicating temperature of a first component communicatively coupled to an information handling system, comprising:

sensing a surface temperature of a portion of the first component;

comparing the surface temperature to a first threshold temperature, wherein the first threshold temperature is the temperature at which a human hand would be physically harmed by contact with the first component;

comparing the surface temperature to a second threshold temperature, wherein the second threshold temperature is approximately ten to fifteen degrees Celsius below the first threshold temperature;

if the surface temperature is below the first threshold temperature, displaying a first temperature warning by a first temperature indicator coupled to the first component;

if the surface temperature is above the first threshold temperature, displaying a second temperature warning by the first temperature indicator;

if the surface temperature is below the second threshold temperature, displaying a third temperature warning by a second temperature indicator coupled to the first component;

if the surface temperature is above the second threshold temperature, displaying a fourth temperature warning by the second temperature indicator.

2. The method of claim 1, wherein the first temperature warning comprises an absence of a visible indicator regarding temperature.

3. The method of claim 1, wherein the third temperature warning comprises an absence of a visible indicator regarding temperature.

4. The method of claim 1, wherein the warning is displayed at a first time and the fourth temperature warning is displayed at a second time, wherein the first time is equal to the second time.

5. The method of claim 1, wherein displaying the second temperature warning comprises displaying the second temperature warning in such a way that the fourth temperature warning is no longer visible.

6. The method of claim 1, wherein the first and second temperature indicators comprise a label affixed to a portion of the first component.

7. The method of claim 1, wherein the first and second temperature indicators comprise paint adhered to a portion of the first component.

8. The method of claim 1, wherein the first and second temperature indicators comprise a mechanical actuator configured to move between at least a first position and a second position, and between a third position and a fourth position, wherein the first position is associated with the first temperature warning, the second position is associated with the second temperature warning, the third position is associated with the third temperature warning, and the fourth position is associated with the fourth temperature warning.

9. The method of claim 1, wherein the first and third temperature warnings are a first color, the second temperature warning is a second color, and the fourth temperature warning is a third color.

10. The method of claim 1, wherein the second and fourth temperature warnings comprise symbols.

11. The method of claim 1, wherein the second and fourth temperature warnings comprise text.

12. The method of claim 1, further comprising:

sensing a surface temperature of a portion of a second component, the second component being in close proximity to the first component;

comparing the surface temperature of the portion of the second component to a first threshold temperature, wherein the first threshold temperature is the temperature at which a human hand would be physically harmed by contact with the second component;

comparing the surface temperature of the portion of the second component to a second threshold temperature, wherein the second threshold temperature is approximately ten to fifteen degrees Celsius below the first threshold temperature;

if the surface temperature is below the first threshold temperature, displaying a first temperature warning by a first temperature indicator coupled to the first component;

if the surface temperature is above the first threshold temperature, displaying a second temperature warning by the first temperature indicator;

if the surface temperature is below the second threshold temperature, displaying a third temperature warning by the second temperature indicator;

if the surface temperature is above the second threshold temperature, displaying a fourth temperature warning by the second temperature indicator.

13. A system for indicating to an operator of an information handling system an unsafe service handling temperature of a first component communicatively coupled to the information handling system, comprising:

a first temperature indicator coupled to the first component, configured to respond to a change in the surface temperature of a portion of the first component by displaying a first temperature warning when a surface temperature is below a first threshold temperature and a second temperature warning when the surface temperature is above the first threshold temperature;

a second temperature indicator coupled to the first component, configured to respond to a change in the surface temperature of the portion of the first component by displaying a third temperature warning when the surface temperature is below a second threshold temperature and a fourth temperature warning when the surface temperature is above the second threshold temperature, wherein:

the first threshold temperature is the temperature at which a human hand would be physically harmed by contact with the first component; and the second threshold temperature is approximately ten to fifteen degrees below the first threshold temperature.

14. The system of claim 13, wherein the first temperature warning comprises an absence of a visible indicator regarding temperature.

15. The system of claim 13, wherein the third temperature warning comprises an absence of a visible indicator regarding temperature.

16. The system of claim 13, wherein the second temperature warning is displayed at a first time and the fourth temperature warning is displayed at a second time, wherein the first time is equal to the second time.

17. The system of claim 13, wherein displaying the fourth temperature warning comprises displaying the fourth temperature warning in such a way that the second temperature warning is no longer visible to the operator.

18. The system of claim 13, wherein the first and second temperature indicators comprise a label affixed to a portion of the first component.

19. The system of claim 13, wherein the first and second temperature indicators comprise paint adhered to a portion of the first component.

20. The system of claim 13, wherein the first and second temperature indicators comprise a mechanical actuator configured to move between at least a first and second positions, and between a third and fourth positions, wherein the first position is associated with the first temperature warning, the second position is associated with the second temperature warning, the third position is associated with the third temperature warning, and the fourth position is associated with the fourth temperature warning.

21. The system of claim 13, wherein the first and third temperature warnings are a first color, the second temperature warning is a second color, and the fourth temperature warning is a third color.

22. The system of claim 13, wherein the second and fourth temperature warnings comprise symbols.

23. The system of claim 13, wherein the second and fourth temperature warnings comprise text.

24. The system of claim 13, wherein:

the first temperature indicator is further configured to respond to a change in the surface temperature of a portion of a second component, the second component in close proximity to the first component, by displaying a first temperature warning when the surface temperature of the portion of the second component is below the first threshold temperature and a second temperature warning when the surface temperature of the portion of the second component is above the first threshold temperature;

a second temperature indicator coupled to the first component, configured to respond to a change in the surface temperature of the portion of the second component, by displaying a third temperature warning when the surface temperature of the portion of the second component is below the second threshold temperature and a fourth temperature warning when the surface temperature of the portion of the second component is above the second threshold temperature.

* * * * *